US005354221A

United States Patent [19]

Doherty, II et al.

[11] Patent Number: 5,354,221

[45] Date of Patent: Oct. 11, 1994

[54] RELEASABLE CONNECTOR ASSEMBLY FOR CATHODE RAY TUBE

[75] Inventors: Patrick D. Doherty, II; David M. McCormick, Camarillo, both of Calif.

[73] Assignee: Reynolds Industries, Incorporated, Los Angeles, Calif.

[21] Appl. No.: 927,416

[22] PCT Filed: Mar. 19, 1991

[86] PCT No.: PCT/US91/01825

§ 371 Date: Sep. 21, 1992

§ 102(e) Date: Sep. 21, 1992

[87] PCT Pub. No.: WO91/15039

PCT Pub. Date: Oct. 3, 1991

[51] Int. Cl.[5] ..... H01R 33/76

[52] U.S. Cl. ..... 439/683; 439/620

[58] Field of Search ..... 439/182, 611, 618, 521, 439/620, 683, 936, 76; 313/51, 318

[56] References Cited

U.S. PATENT DOCUMENTS 2,393,616 1/1946 De Reamer et al. ..... 439/243
3,219,965 11/1965 D'Adamo ..... 439/618
3,958,854 5/1976 Arrington et al. ..... 439/182
4,131,331 12/1978 Kendall, Jr. ..... 439/521 X
4,533,851 8/1985 Block et al. ..... 439/612 X
4,597,620 7/1986 Lindner et al. ..... 439/320 X
4,605,272 8/1986 Myers et al. ..... 439/274 X
4,618,206 10/1986 Donofrio et al. ..... 439/618
5,154,638 10/1992 Sireul et al. ..... 439/618 X

*Primary Examiner*—Khiem Nguyen
*Attorney, Agent, or Firm*—Pretty, Schroeder, Brueggemann & Clark

[57] ABSTRACT

A releasable cathode ray tube connector assembly exhibiting enhanced dielectric standoff for its high-voltage contacts, even at high altitudes where voltage breakdowns frequently can occur. A substantially rigid dielectric sleeve encircles a base portion of a high-voltage contact projecting from the cathode ray tube stem, and a resilient sleeve carried in a cylindrical recess of a mating plug assembly is sized to slide over this rigid sleeve and substantially fill the annular space surrounding the rigid sleeve. An enhanced voltage seal is thereby provided.

25 Claims, 4 Drawing Sheets

FIG. 1
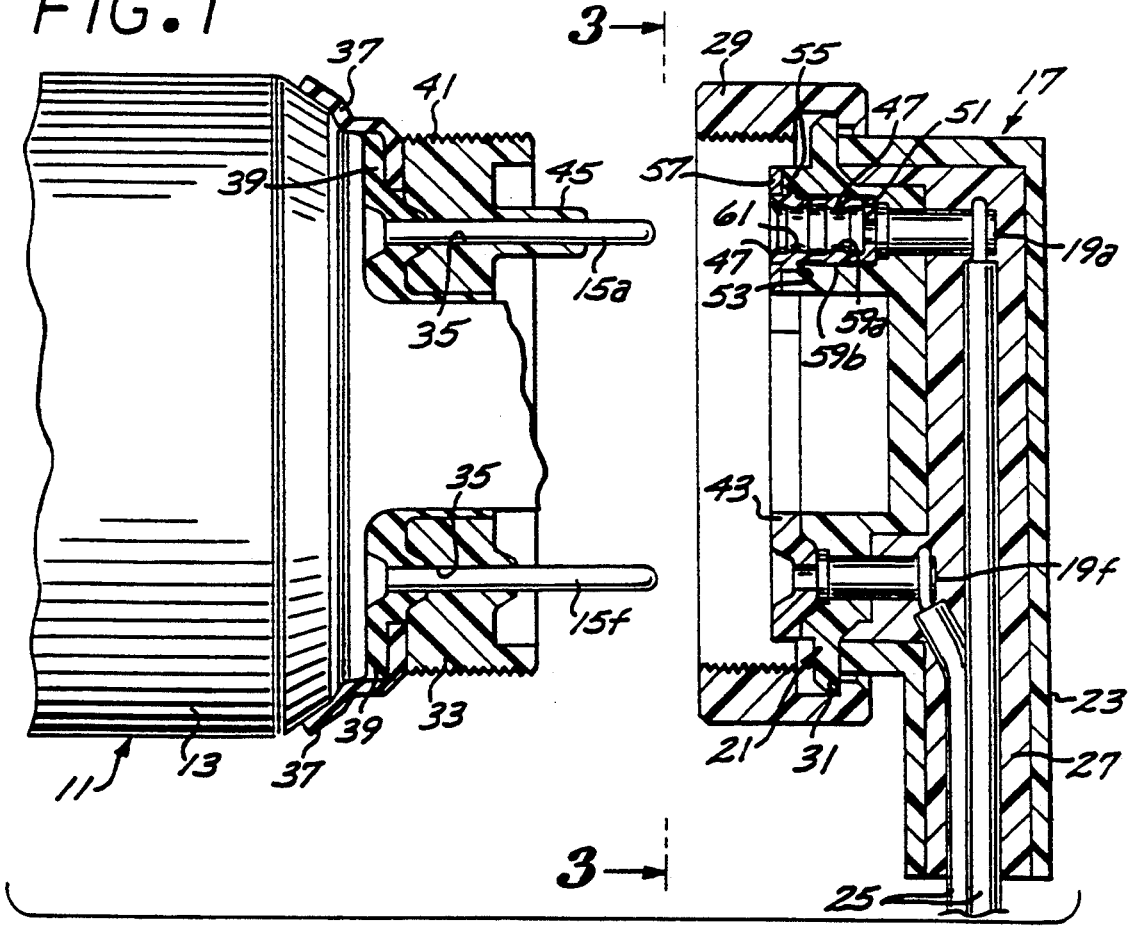
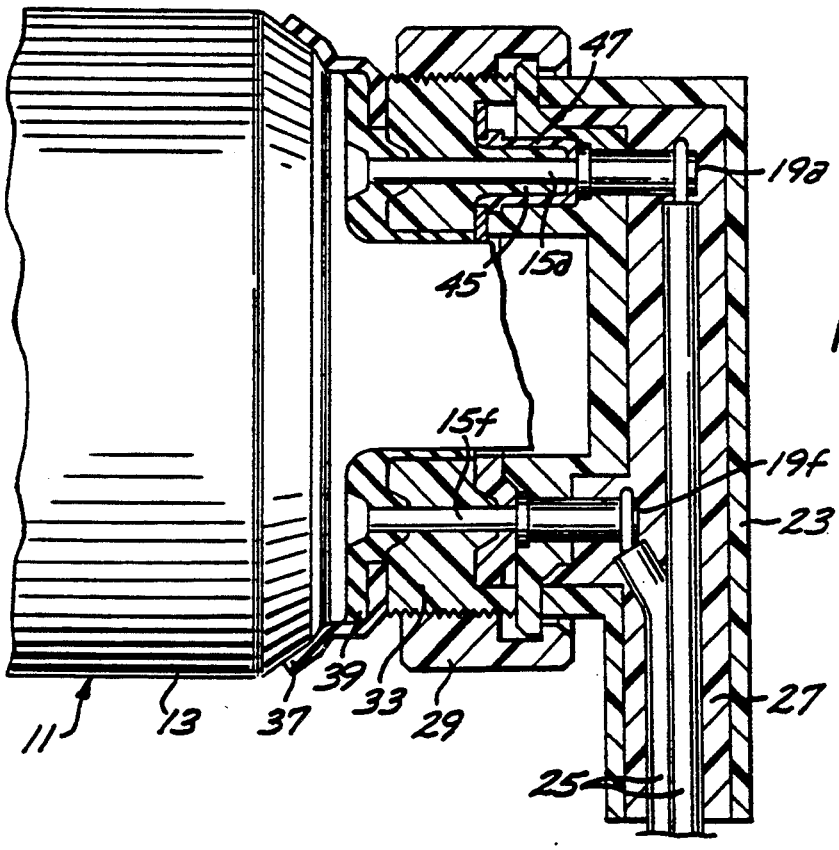
FIG. 2

FIG. 3
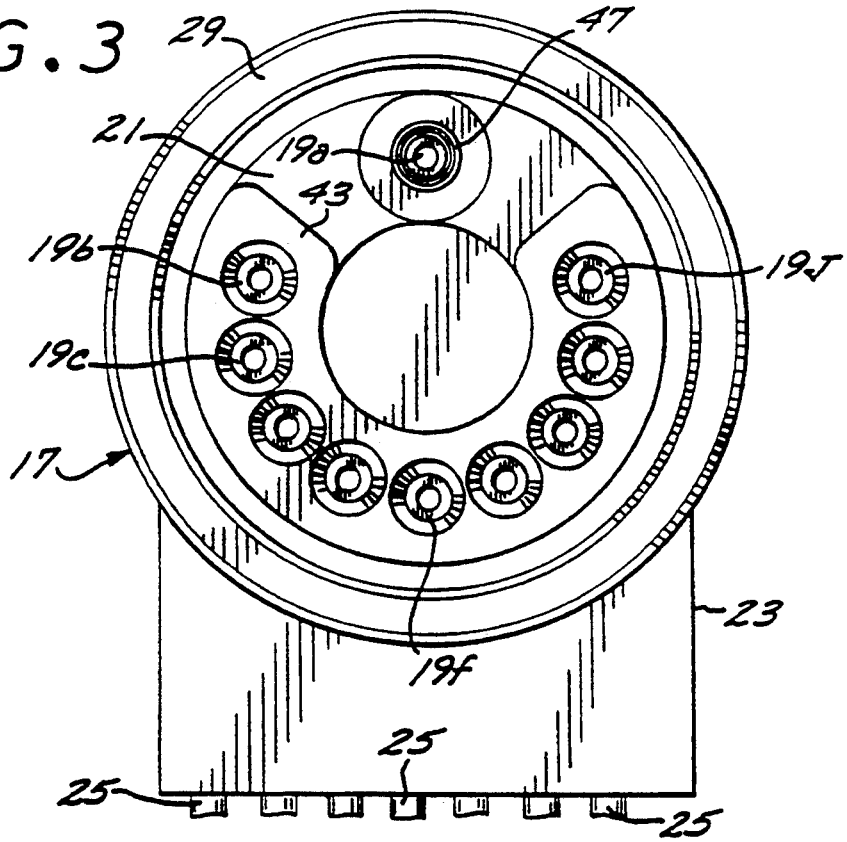
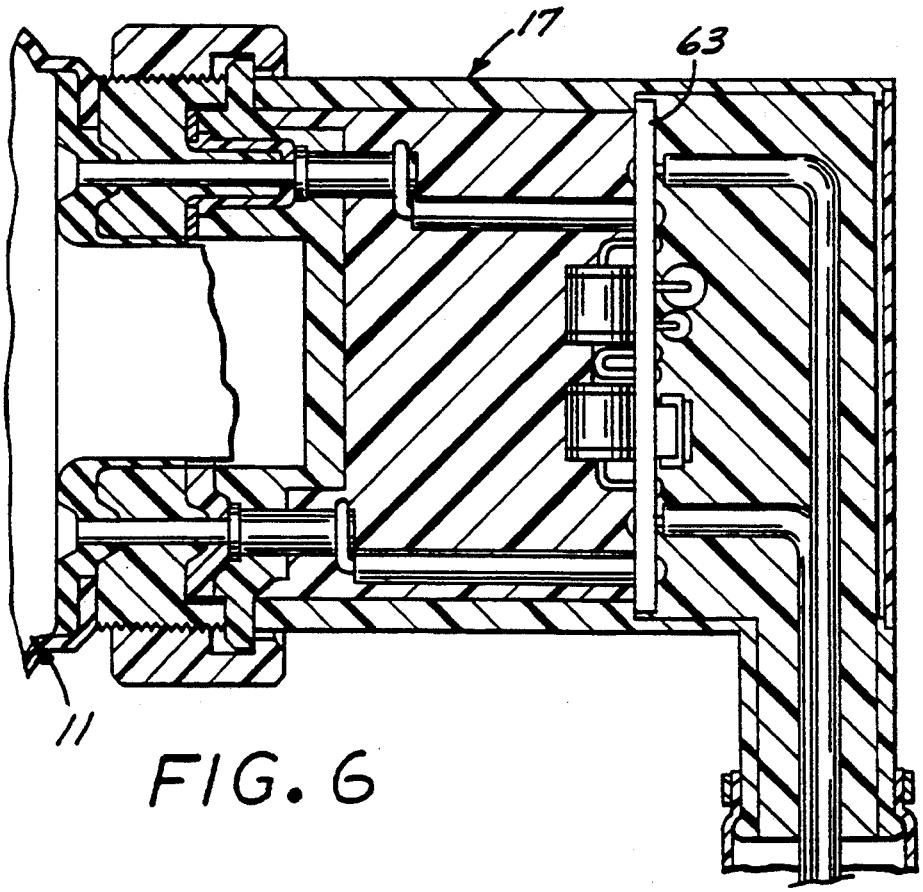
FIG. 6

RELEASABLE CONNECTOR ASSEMBLY FOR CATHODE RAY TUBE

BACKGROUND OF THE INVENTION

This invention relates generally to electrical connector assemblies for cathode ray tubes and, more particularly, to connector assemblies that are selectively releasable and that function effectively at high altitudes.

Conventional cathode ray tubes (CRT's) typically each include an integral glass stem on their rear sides, with a plurality of electrical contacts projecting rearwardly from the stem. The voltage levels of signals applied to at least one of the contacts can typically be on the order of 5000 to 7000 volts dc.

In applications limited to normal, sea level environments, where the air pressure is on the order of one atmosphere, the CRT stem is normally adapted to receive a mating plug assembly having contacts arranged and sized to mate with the contacts of the CRT stem. Insulating partitions are normally provided on the stem, to electrically isolate the high-voltage contact from the adjacent lower-voltage contacts. Such partitions are considered to provide adequate dielectric standoff at normal atmospheric pressures.

The connector assembly described briefly above does not operate effectively at altitudes, e.g., 40,000 to 70,000 feet, such as are encountered by military and commercial aircraft. At such high altitudes, the low air pressure significantly reduces the dielectric standoff between adjacent contacts. A voltage breakdown therefore can occur between the high-voltage contact and nearby lower-voltage contacts, unless special steps are taken to enhance the dielectric standoff. In the past, enhanced dielectric standoff typically has been achieved by soldering electrical conductors directly to the CRT contacts and then potting the entire assembly using an insulative silicone rubber material. This structure is effective at preventing a voltage breakdown, but has not proven to be entirely satisfactory, because it is not readily releasable. The connector assembly ordinarily must be destroyed to facilitate removal of the CRT for servicing or replacement. In addition, cold temperatures normally associated with high altitude applications, as well as thermal cycling, can adversely affect the integrity of the potting material.

It should, therefore, be appreciated that there is a continuing need for an improved CRT connector assembly that is readily releasable yet effective in providing sufficient dielectric standoff to allow effective operation even at high altitudes. The present invention fulfills this need.

SUMMARY OF THE INVENTION

The present invention is embodied in an improved electrical connector assembly for a cathode ray tube (CRT) that is selectively releasable yet provides adequate dielectric standoff to allow effective operation even at high altitudes. More particularly, the connector assembly is used with a CRT having a glass stem and a plurality of electrical contacts projecting from the stem, with at least one of the contacts being adapted to carry a high voltage, e.g., 5000 to 7000 volts dc. A plug assembly having a plurality of contacts adapted to mate with the contacts of the CRT is releasably attachable to the CRT stem. A cylindrical wall of the plug assembly encircles the plug assembly's high-voltage contact, thus defining a cylindrical recess around the contact. The connector assembly further includes a substantially rigid dielectric sleeve encircling a base portion of the CRT's high-voltage contact, leaving exposed the contact's remote end, and a resilient dielectric sleeve located within the plug assembly's cylindrical recess. The resilient sleeve is sized to slide over the substantially rigid dielectric sleeve and to be radially compressed between that sleeve and the cylindrical wall. This substantially fills the space surrounding the substantially rigid dielectric sleeve and thereby provides a high-voltage seal between the mating high-voltage contacts and the remaining, lower-voltage contacts of the CRT and the plug assembly.

The substantially rigid dielectric sleeve can take one of several forms. In one embodiment, the sleeve is part of a base receptacle bonded to the stem of the CRT and adapted to physically support the plurality of CRT contacts. In this embodiment, the sleeve is an integral part of the base receptacle, which is formed of a molded plastic material. In an alternative embodiment, the substantially rigid dielectric sleeve is formed of glass and is an integral extension of the CRT stem. In yet another embodiment, the substantially rigid dielectric sleeve is tubular in shape, formed of a ceramic material, and secured directly to the CRT stem, encircling the high-voltage contact. This ceramic material should have a thermal expansion coefficient substantially the same as that of the glass stem.

The resilient sleeve can be formed as a separate element that can be removed and replaced in the cylindrical recess of the plug assembly. Alternatively, it can be molded directly to the plug assembly. This latter approach is particularly advantageous when the connector assembly has a relatively small physical size.

In an optional feature, the base receptacle that is bonded to the CRT stem can include aligned female and male contacts that effectively extend the length of the CRT's high-voltage contact. In this case, the substantially rigid sleeve encircles the female contact. This enables the resilient sleeve feature to be incorporated into connector assemblies for CRTs having a small size, without requiring the contacts of the CRT to be specially configured.

Other features and advantages of the present invention should become apparent from the following description of the preferred embodiments, taken in conjunction with the accompanying drawings, which illustrate, by way of example, the principles of the invention.

BRIEF DESCRIPTION OF THE DRAWINGS

FIG. 1 is a side sectional view of a first embodiment of a releasable electrical connector assembly for a cathode ray tube in accordance with the invention, shown in its unmated condition.

FIG. 2 is a side sectional view of the releasable connector assembly of FIG. 1, shown in its mated condition.

FIG. 3 is a plan view of the plug assembly portion of the connector assembly of FIGS. 1 and 2, taken substantially in the direction of the arrows 3—3 in FIG. 1.

FIG. 6 is a side sectional view of a fourth embodiment of a releasable connector assembly in accordance with the invention, similar to the embodiment of FIGS. 1–3, but further including a circuit board carried within the plug assembly.

DESCRIPTION OF THE PREFERRED EMBODIMENTS

Figure 4:
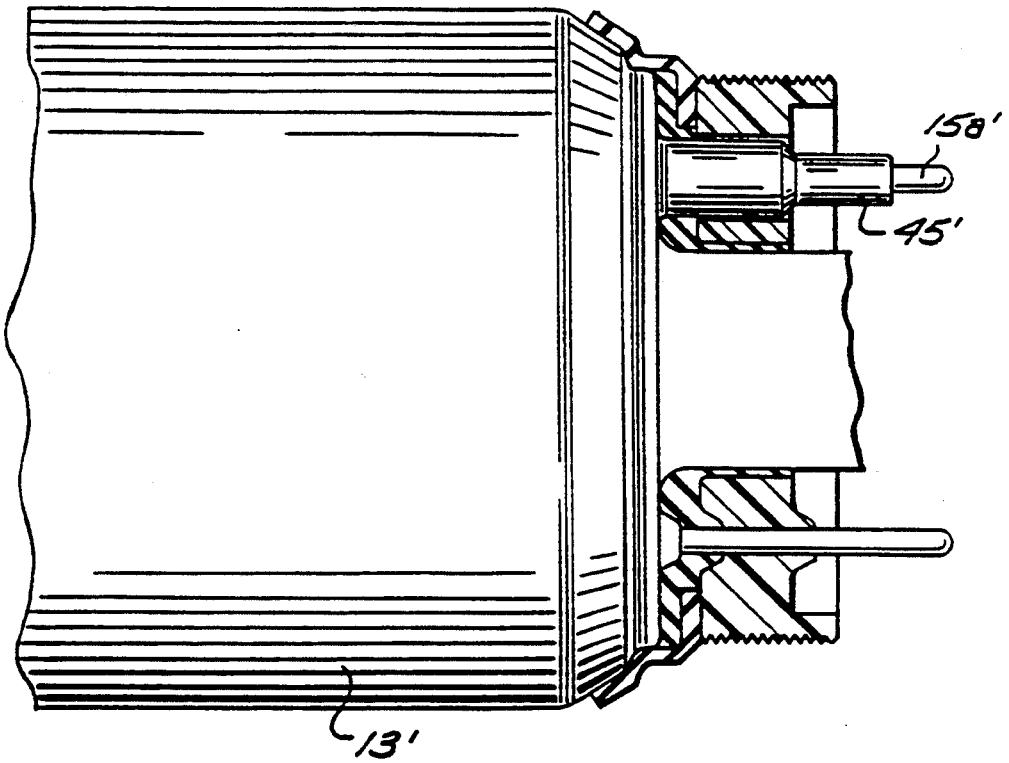
FIG. 4 is a fragmentary side sectional view of a second embodiment of a releasable connector assembly in accordance with the invention, showing the high-voltage contact encircled by a cylindrical extension of the CRT's glass stem.

With reference now the exemplary drawings, and particularly to FIGS. 1–3, there is shown a releasable connector assembly for a cathode ray tube (CRT) 11 that operates effectively even at high altitudes. The CRT includes a glass stem 13 on its rear side, with a plurality of parallel male contacts projecting rearwardly from the end of the stem, in a generally circular pattern. Two of the contacts are shown in FIGS. 1 and 2 at 15*a* and 15*f*. The contact 15*a* is adapted to carry voltage levels on the order of 5000 to 7000 volts dc, while the remaining contacts are all adapted to carry lower voltages in the range of 6.0 to 800 volts dc.

Releasably connectable to the stem 13 of the CRT 11 is a plug assembly 17 having a plurality of parallel female contacts 19*a*–19*j*, arranged in a circular pattern, as shown in FIG. 3. The plug assembly includes a plastic plug body 21 that physically supports the female contacts in their predetermined circular orientation and a rear case 23 having an interior recess through which a number of high-voltage cables 25 extend. Separate conductors of the cables are soldered to the rear ends of the various female contacts. After such soldering has been completed, the recess is filled with a silicone rubber potting material 27, to provide an effective voltage seal. A threaded coupling nut 29 encircles the plug body 21, being retained by an outwardly-projecting annular flange 31 in the plug body.

Secured to the stem 13 of the CRT 11 is a plastic base receptacle 33 having a circular arrangement of openings 35 sized and positioned to slide over the circular arrangement of male contacts 15. A portion of each such contact projects beyond the base receptacle, as shown in FIG. 1. The base receptacle thereby physically supports the male contacts and holds them securely in position to engage the mating female contacts 19 of the plug assembly 17.

A circular, silicone rubber potting skirt 37 is positioned at the circular periphery of the CRT stem's rear end, beneath the base receptacle 33. The skirt and the base receptacle cooperate to define an annular recess through which the base ends of all of the male contacts 15 extend. A silicone rubber adhesive material 39 is injected into this recess both to serve as an adhesive for the skirt and base receptacle and to electrically isolate the contacts from each other. The base receptacle's circular periphery is threaded, as indicated by the reference numeral 41, so as to receive the threaded coupling nut 29 of the plug assembly 17. A secure connection of the connector assembly in the mated condition (FIG. 2) thereby is provided.

A U-shaped low-voltage plastic seal 43 overlies the portion of the plug body 21 that supports the nine low-voltage female contacts 19*b*–19*j*. When the plug assembly 17 is mated with the CRT stem 13, as shown in FIG. 2, this low-voltage seal is sandwiched between the plug body and the base receptacle 33. This effectively seals these low-voltage contacts from each other. However, additional precautions need to be taken with respect to the high-voltage contacts 15*a* and 19*a*.

An effective voltage seal for the high-voltage contacts 15*a* and 19*a* is provided by a cylindrical extension sleeve 45 of the base receptacle 33, which encircles a further portion of the male-contact 15*a*, in cooperation with a resilient sleeve 47 located within a cylindrical recess formed by a cylindrical wall 51 in the plug body 21. When the plug assembly 17 is mated with the CRT stem 13, the resilient sleeve slides over the cylindrical extension sleeve 45 and is radially compressed between that extension sleeve and the cylindrical wall of the plug body. The resilient sleeve thereby substantially fills the entire annular space between the extension sleeve and the cylindrical wall. Filling the space in this way inhibits the creation of a corona that could erode the cylindrical sleeves 45 and 47 and the cylindrical wall 51.

This configuration ensures that an effective dielectric seal is provided along the entire length of the high-voltage signal path. This includes the potting material 27 that encircles the high-voltage cable 25 and the female contact 19*a*, the potting material 39 that encircles the base end of the high-voltage contact 15*a*, and the base receptacle 33, with its cylindrical extension sleeve 45 and encircling resilient sleeve 47. Sufficient dielectric standoff is thereby provided to allow the connector assembly to be used effectively even at altitudes such as 40,000 to 70,000 feet, where conventional releasable CRT connector assemblies can breakdown.

The resilient sleeve 47 has a generally cup-shaped configuration, with an outwardly-projecting flange 53 near its upper end, which is received in a conformably-shaped annular recess 55 formed in the cylindrical wall 51 of the plug body 21. A ring-shaped retainer 57 is positioned in front of this recess, to retain the sleeve in place. Radially-aligned annular ridges 59*a* and 59*b* are formed in the resilient sleeve's inner and outer surfaces, respectively, to provide a thickness enlargement that is compressed when the connector assembly is in its mated condition (FIG. 2). A further annular ridge 61 is formed in the interior wall of the seal, opposite the annular flange 53, to provide a further location for such radial compression when in the mated condition. U.S. Pat. No. 4,605,272, issued to Melvin K. Myers et al. and entitled "High Voltage Electrical Connector," describes one suitable resilient sleeve of this kind.

It will be noted in FIG. 3 that the high-voltage contact 19*a* is spaced further from the nearest lower-voltage contacts 19*b* and 19*j*, than the lower-voltage contacts are spaced from each other. This provides further projection against a voltage breakdown.

FIG. 4 depicts a portion of an alternative embodiment of a releasable connector assembly in accordance with the invention. Elements of this embodiment that correspond to the elements of the embodiment of FIGS. 1–3 are identified by the same reference numeral, but with an accompanying hyphen. This embodiment differs from the embodiment of FIGS. 1–3 in the area of the cylindrical seal surrounding the high-voltage male contact 15*a*'. In this embodiment, a cylindrical extension sleeve 45' of the glass stem 13' itself is substituted for the cylindrical extension sleeve 45 of the base receptacle 33 in the embodiment of FIGS. 1–3. This embodiment, of course, requires that a special modification be made to the CRT's glass stem.

Figure 5:
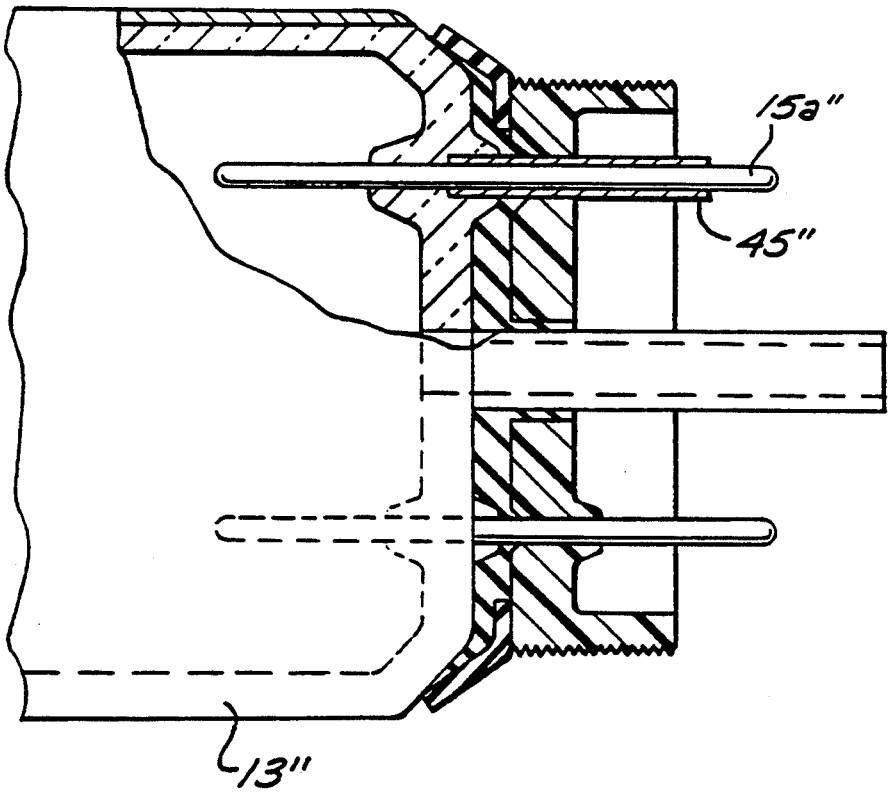
FIG. 5 is a fragmentary side sectional view of a third embodiment of a releasable connector assembly in accordance with the invention, showing the high-voltage contact encircled by a ceramic sleeve.

FIG. 5 depicts a portion of a third embodiment of a releasable connector assembly in accordance with the invention. Elements of this embodiment that correspond to elements of the earlier-described embodiments are identified by the same reference numeral, but with two accompanying hyphens. This embodiment is similar to the embodiment of FIG. 4, except that it includes a ceramic sleeve 45'' in place of the glass extension sleeve 45'. The ceramic sleeve, which is secured in place during manufacture of the CRT 11'', is preferably formed of a material selected to have a thermal expansion coefficient substantially the same as that of the glass stem 13''.

FIG. 6 depicts a fourth embodiment of the invention, which is identical in many respects to the embodiment of FIGS. 1–3 in the area of the high-voltage seal, but which differs in that it further includes a circuit board 63 with associated electrical components located within a potted cavity of the plug assembly 17. Alternatively, the electrical components can be mounted in the cavity without a circuit board. Placement of these electrical components in such proximity to the CRT 11 provides enhanced protection against undesired transient voltages.

Figure 7:
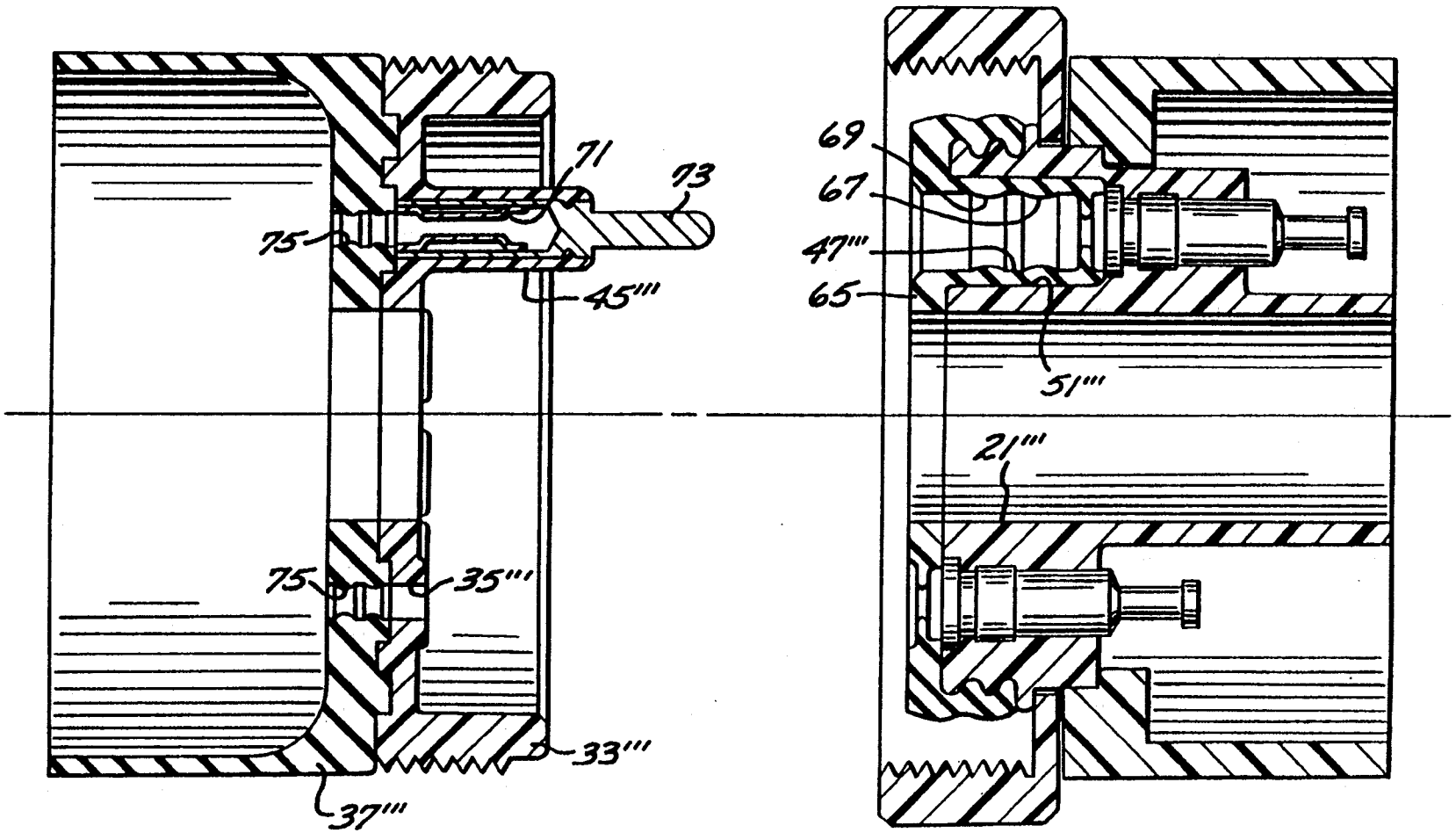
FIG. 7 is a side sectional view of a fifth embodiment of a releasable electrical connector assembly for a cathode ray tube in accordance with the invention, shown in its unmated condition and apart from the cathode ray tube.

FIG. 7 depicts yet another embodiment of a releasable connector assembly in accordance with the invention. Elements of this embodiment that correspond to elements of the earlier-described embodiments are identified by the same reference numerals, but with three accompanying hyphens. In this embodiment, the function of the resilient sleeve of the earlier embodiments is performed by a silicone rubber layer 65 that is molded directly to the side of the plug body 21''' that faces the CRT stem. A sleeve portion 47''' of the layer 65 lies within the cylindrical recess defined by the cylindrical wall 51''' of the plug body. Annular ridges 67 and 69 are formed in the sleeve portion's inner surface, to form thickness enlargements that are compressed when the connector assembly is in its mated condition.

The embodiment of FIG. 7 is particularly suitable for applications where the connector assembly is small in physical size. In these applications, the sleeve portion 47''' of the silicone rubber layer 65 is considered too thin to have sufficient durability for separate handling and insertion into the cylindrical recess of the plug body 21'''. By molding the sleeve portion 47''' in place on the plug body, no such handling is required. A portion of the layer 65 extends around, and envelopes, the outer periphery of the plug body, to ensure that the layer and plug body remain intimately engaged with each other.

It will be noted that the base receptacle 33''' of the embodiment of FIG. 7 differs from the corresponding base receptacle 33 of the embodiment of FIGS. 1–3 in that it further includes a female contact 71 and male contact 73, which are aligned with each other and electrically connected together. The female contact is positioned to mate with the high-voltage contact of the CRT, and the cylindrical extension sleeve 45''' of the base receptacle 33''' encircles this female contact. This arrangement effectively extends the length of the CRT stem's male contact. It enables the resilient sleeve feature to be incorporated into connector assemblies for small CRTs without requiring the contacts of the CRT stem to be specially configured.

The silicone rubber potting skirt 37''' is molded to the entire underside of the base receptacle 33''' and it includes openings 75 aligned with the openings 35''' of the base receptacle. Annular ridges 77 and 79 in the openings 75 help to prevent the silicone rubber adhesive material from wicking upwardly through the base receptacle openings when the base receptacle is bonded to the CRT stem. This potting skirt configuration can be used advantageously in the embodiments of FIGS. 16, as well.

It should be appreciated from the foregoing description that the present invention provides an improved releasable CRT connector assembly exhibiting enhanced dielectric standoff for its high-voltage contacts, even at high altitudes where voltage breakdowns frequently can occur. A substantially rigid dielectric sleeve encircles a base portion of a high-voltage contact projecting from the CRT stem, and a resilient sleeve carried in a cylindrical recess of a mating plug assembly is sized to slide over this rigid sleeve and substantially fill the space surrounding the rigid sleeve. An enhanced voltage seal is thereby provided.

Although the present invention has been described in detail with reference only to the presently preferred embodiments, those of ordinary skill in the art will appreciate that various modifications can be made without departing from the invention. Accordingly, the invention is defined only by the following claims.

We claim:

1. A releasable connector assembly for a cathode ray tube having a glass stem and a plurality of electrical contacts projecting from the stem, with at least one of the contacts being adapted to carry a high voltage, the connector assembly comprising:

a substantially rigid dielectric sleeve encircling a base portion of the high-voltage contact of the cathode ray tube, leaving exposed the contact's remote end;

a plug assembly including a plurality of electrical contacts adapted to mate with the plurality of contacts of the cathode ray tube, the plug assembly further including a cylindrical wall that defines cylindrical recess encircling a high-voltage contact thereof, wherein the plug assembly is adapted to be selectively attachable to, and releasable from, the cathode ray tube stem, and wherein the high-voltage contacts of the plug assembly and the cathode ray tube mate with each other when the plug assembly is selectively attached to the cathode ray tube stem; and a resilient dielectric sleeve located within the plug assembly's cylindrical wall recess and sized to be slidable over the substantially rigid dielectric sleeve when the plug assembly is selectively attached to the cathode ray tube stem, whereupon the resilient sleeve is radially compressed and deformed between, and substantially fills a space between, the substantially rigid dielectric sleeve and the cylindrical wall recess, such that a high-voltage seal is provided between the mating high-voltage contacts and the other contacts of the cathode ray tube and the plug assembly.

2. A releasable connector assembly as defined in claim 1, wherein the substantially rigid dielectric sleeve is part of a base receptacle bonded to the stem of cathode ray tube and adapted to physically support the plurality of contacts of the cathode ray tube.

3. A releasable connector assembly as defined in claim 2, wherein:

the substantially rigid dielectric sleeve is an integral part of the base receptacle; and the base receptacle is formed of a molded plastic material.

4. A releasable connector assembly as defined in claim 2, wherein:

the plurality of electrical contacts of the cathode ray tube are all male and are elongated and arranged substantially parallel with each other; and the base receptacle includes a female electrical contact sized and positioned to electrically engage a selected one of the plurality of male contacts of the cathode ray tube, a male electrical contact aligned with the female contact and constituting the high-voltage contact, and a plurality of apertures, sized and positioned to receive the plurality of male contacts of the cathode ray tube other than the contact engageable with the female contact.

5. A releasable connector assembly as defined in claim 4, wherein:

the plurality of male contacts project from the stem of the cathode ray tube substantially equal distances; and the male contact of the base receptacle projects a predetermined distance beyond the male contacts of the cathode ray tube.

6. A releasable connector assembly as defined in claim 1, wherein the substantially rigid dielectric sleeve is formed of glass and is an integral extension of the stem of the cathode ray tube.

7. A releasable connector assembly as defined in claim 1, wherein:

the substantially rigid dielectric sleeve is tubular in shape and secured directly to the stem of the cathode ray tube; and the substantially rigid dielectric sleeve is formed of a ceramic material that has a thermal expansion coefficient substantially the same as that of the glass stem.

8. A releasable connector assembly as defined in claim 1, wherein the substantially rigid dielectric sleeve is substantially cylindrical and encircles and intimately contacts the high-voltage contact over the sleeve's substantially entire length.

9. A releasable connector assembly as defined in claim 1, wherein:

the resilient sleeve includes an inner side, an outer side, an inner annular ridge extending completely around its inner side, and an outer annular ridge extending completely around its outer side, in alignment with the inner annular ridge; and the inner and outer annular ridges of the resilient sleeve are radially compressed between the substantially rigid dielectric sleeve and the cylindrical wall of the plug assembly when the plug assembly is selectively attached to the cathode ray tube stem.

10. A releasable connector assembly a defined in claim 1, wherein the resilient dielectric sleeve is selectively removable and replaceable in the cylindrical recess of the plug assembly.

11. A releasable connector assembly as defined in claim 1, wherein:

the plug assembly further includes a substantially rigid plug body that forms the cylindrical wall that defines the cylindrical recess; and the resilient dielectric sleeve is molded directly to the substantially rigid plug body.

12. A releasable connector assembly as defined in claim 1, wherein:

the plug assembly includes means defining an enclosable cavity; and the connector assembly further includes a plurality of electrical components located within the enclosable cavity of the plug assembly and electrically connected to one or more contacts of the plug assembly, and a potting material enveloping the electrical components and thereby substantially filling the enclosable cavity of the plug assembly.

13. A combination comprising:

a cathode ray tube having a glass stem and a plurality of elongated, substantially parallel electrical contacts projecting from the stem, with at least one of the contacts being adapted to carry a high voltage; and a connector assembly including a substantially rigid dielectric sleeve encircling a base portion of the high-voltage contact of the cathode ray tube, leaving exposed the contact's remote end, a plug assembly including a plurality of electrical contacts adapted to mate with the plurality of contacts of the cathode ray tube, the plug assembly further including a cylindrical wall that defines a cylindrical recess encircling a high-voltage contact thereof, wherein the plug assembly is adapted to be selectively attachable to, and releasable from, the cathode ray tube stem, and wherein the high-voltage contacts of the plug assembly and the cathode ray tube mate with each other when the plug assembly is selectively attached to the cathode ray tube stem, and a resilient, generally cylindrical dielectric sleeve located within the plug assembly's cylindrical wall recess and sized to be slidable over the substantially rigid dielectric sleeve when the plug assembly is selectively attached to the cathode ray tube stem, whereupon the resilient sleeve is radially compressed and deformed between, and substantially fills a space between, the substantially rigid dielectric sleeve and the cylindrical wall recess, such that a high-voltage seal is provided between the mating high-voltage contacts and the other contacts of the cathode ray tube and the plug assembly.

14. A combination as defined in claim 13, wherein the substantially rigid dielectric sleeve is part of a base receptacle bonded to the stem of the cathode ray tube and adapted to physically support the plurality of contacts of the cathode ray tube.

15. A combination as defined in claim 14, wherein:

the substantially rigid dielectric sleeve is an integral part of the base receptacle; and the base receptacle is formed of a molded plastic material.

16. A combination as defined in claim 14, wherein:

the plurality of the electrical contacts of the cathode ray tube are all male and are elongated and arranged substantially parallel with each other; and the base receptacle includes a female electrical contact sized and positioned to electrically engage a selected one of the plurality of male contacts of the cathode ray tube, a male electrical contact aligned with the female contact and constituting the high-voltage contact, and a plurality of apertures sized and positioned to receive the plurality of male contacts of the cathode ray tube other than the contact engageable with the female contact.

17. A combination as defined in claim 16, wherein:

the plurality of male contacts project from the stem of the cathode ray tube substantially equal distances; and the male contact of the base receptacle projects a predetermined distance beyond the male contacts of the cathode ray tube.

18. A combination as defined in claim 13, wherein the substantially rigid dielectric sleeve is formed of glass and is an integral extension of the stem of the cathode ray tube.

19. A combination as defined in claim 13, wherein:

the substantially rigid dielectric sleeve is tubular in shape and secured directly to the stem of the cathode ray tube; and the substantially rigid dielectric sleeve is formed of a ceramic material that has a thermal expansion coefficient substantially the same as that of the glass stem.

20. A combination as defined in claim 13, wherein the substantially rigid dielectric sleeve is substantially cylindrical and encircles and intimately contacts the high-voltage contact over the sleeve's substantially entire length.

21. A combination as defined in claim 13, wherein:

the resilient sleeve includes an inner side, an outer side, an inner annular ridge extending completely around its inner side, and an outer annular ridge extending completely around its outer side, in alignment with the inner annular ridge; and the inner and outer annular ridges of the resilient sleeve are radially compressed between the substantially rigid dielectric sleeve and the cylindrical wall of the plug assembly when the plug assembly is selectively attached to the cathode ray tube stem.

22. A combination as defined in claim 13, wherein the resilient dielectric sleeve is selectively removable and replaceable in the cylindrical recess of the plug assembly.

23. A combination as defined in claim 13, wherein:

the plug assembly further includes a substantially rigid plug body that forms the cylindrical wall that defines the cylindrical recess; and the resilient dielectrical sleeve is molded directly to the substantially rigid plug body.

24. A combination as defined in claim 13, wherein:

the plug assembly includes means defining an enclosable cavity; and the connector assembly further includes a plurality of electrical components located within the enclosable cavity of the plug assembly and electrically connected to one or more contacts of the plug assembly, and a potting material enveloping the electrical components and thereby substantially filling the enclosable cavity of the plug assembly.

25. A combination comprising:

a cathode ray tube having a glass stem and a plurality of electrical contacts projecting from the stem, with at least one of the contacts being adapted to carry a high voltage; and a connector assembly including a base receptacle formed of a molded plastic material and bonded to the stem of the cathode ray tube and adapted to physically support the plurality of contacts of the cathode ray tube, the base receptacle including a substantially rigid dielectric sleeve encircling a base portion of the high-voltage contact of the cathode ray tube, leaving exposed the contact's remote end, a plug assembly including a plurality of electrical contacts adapted to mate with the plurality of contacts of the cathode ray tube, the plug assembly further including a cylindrical wall that defines a cylindrical recess encircling a high-voltage contact thereof, wherein the plug assembly is adapted to be selectively attachable to, and releasable from, the cathode ray tube stem, and wherein the high-voltage contacts of the plug assembly and the cathode ray tube mate with each other when the plug assembly is selectively attached to the cathode ray tube stem, and a resilient, generally cylindrical dielectric sleeve located within the plug assembly's cylindrical wall recess wherein the resilient sleeve includes an inner side, an outer side, an inner annular ridge extending completely around its inner side and an outer annular ridge extending completely around its outer side, in alignment with the inner annular ridge, and wherein the resilient sleeve is sized to be slidable over the substantially rigid dielectric sleeve when the plug assembly is selectively attached to the cathode ray tube stem, whereupon the resilient sleeve substantially fills an annular space between the substantially rigid dielectric sleeve and the cylindrical wall of the plug assembly, and the inner and outer annular ridges of the resilient sleeve are radially compressed and deformed between the substantially rigid dielectric sleeve and the cylindrical wall recess of the plug assembly when the plug assembly is selectively attached to the cathode ray tube stem, such that a high-voltage seal is provided between the mating high-voltage contacts and the other contacts of the cathode ray tube and the plug assembly.

* * * * *